US005224746A

United States Patent [19]

Mullins

[11] Patent Number: 5,224,746

[45] Date of Patent: Jul. 6, 1993

[54] DRUM HANDLING APPARATUS

[76] Inventor: William E. Mullins, 4002 E. Court, Deer Park, Tex. 77536

[21] Appl. No.: 852,398

[22] Filed: Mar. 16, 1992

[51] Int. Cl.[5] ..... B66C 1/42

[52] U.S. Cl. ..... 294/87.1; 294/119.2; 294/119.3

[58] Field of Search ..... 294/119.2, 119.3, 87.1, 294/87.2, 31.2, 86.4, 150; 410/36, 37, 50, 100

[56] References Cited

U.S. PATENT DOCUMENTS

| | | | |
|---|---|---|---|
| 3,253,854 | 5/1966 | Hollander, Jr. | 294/119.2 |
| 3,388,792 | 6/1968 | Jones | 410/36 X |
| 3,970,342 | 7/1976 | Cotton | 294/86.4 |
| 4,492,399 | 1/1985 | Randen et al. | 294/87.1 X |
| 4,678,221 | 7/1987 | Josenhans | 294/87.2 X |
| 4,911,605 | 3/1990 | Berg | 294/87.1 X |

*Primary Examiner*—Johhny D. Cherry

*Assistant Examiner*—Dean J. Kramer

*Attorney, Agent, or Firm*—Leon Gilden

[57] ABSTRACT

An outer cylindrical housing mounts a control shaft coaxially extending upwardly from the housing through a top plate. A ratchet bracket is mounted to the control shaft above the top plate, with a drive end extending above the ratchet sprocket for reception within a handle to effect rotation of the control shaft. A plurality of encircling straps are mounted to the control shaft spaced apart ninety degrees at an annular orientation relative to one another, with an encircling strap of each of the encircling straps extending through a slot through the outer housing. Each slot is arranged in a parallel relationship relative to one another in an annular configuration. Rotation of the control shafts effects winding of the encircling straps about the control shaft for their clamping about a drum member.

5 Claims, 4 Drawing Sheets

DRUM HANDLING APPARATUS

BACKGROUND OF THE INVENTION

1. Field of the Invention

The field of invention relates to drum handling apparatus, and more particularly pertains to a new and improved drum handling apparatus arranged for the clamping of plural pairs of drums in a single event.

2. Description of the Prior Art

Drum handling apparatus of various types have been utilized in the prior art, wherein drums due to their bulky and awkward nature require special handling and tools for their control and manipulation. Such apparatus is exemplified in the U.S. Pat. No. 4,359,241 to Kistner wherein a plurality of hooks spaced one hundred twenty degrees relative to one another extend upwardly from a drum for clamping to an upper flange of an associated drum structure.

U.S. Pat. No. 4,913,371 to Margetts and U.S. Pat. No. 4,913,608 to Royball set forth strap tightening apparatus.

As such, it may be appreciated that there continues to be a need for a new and improved drum handling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of drum handling apparatus now present in the prior art, the present invention provides a drum handling apparatus wherein the same is arranged for the clamping of plural pairs of drums in a unitary manner As such, the general purpose of the present invention, which will be described subsequently in greater detail, is to provide a new and improved drum handling apparatus which has all the advantages of the prior art drum handling apparatus and none of the disadvantages.

To attain this, the present invention provides an outer cylindrical housing mounting a control shaft coaxially extending upwardly from the housing through a top plate. A ratchet bracket is mounted to the control shaft above the top plate, with a drive end extending above the ratchet sprocket for reception within a handle to effect rotation of the control shaft. A plurality of encircling straps are mounted to the control shaft spaced apart ninety degrees at an annular orientation relative to one another, with an encircling strap of each of the encircling straps extending through a slot through the outer housing. Each slot is arranged in a parallel relationship relative to one another in an annular configuration. Rotation of the control shafts effects winding of the encircling straps about the control shaft for their clamping about a drum member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drum handling apparatus which has all the advantages of the prior art drum handling apparatus and none of the disadvantages.

It is another object of the present invention to provide a new and improved drum handling apparatus which may be easily and efficiently manufactured and marketed.

It is a further object of the present invention to provide a new and improved drum handling apparatus which is of a durable and reliable construction.

An even further object of the present invention is to provide a new and improved drum handling apparatus which is susceptible of a low cost of manufacture with regard to both materials and labor, and which accordingly is then susceptible of low prices of sale to the consuming public, thereby making such drum handling apparatus economically available to the buying public.

Still yet another object of the present invention is to provide a new and improved drum handling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
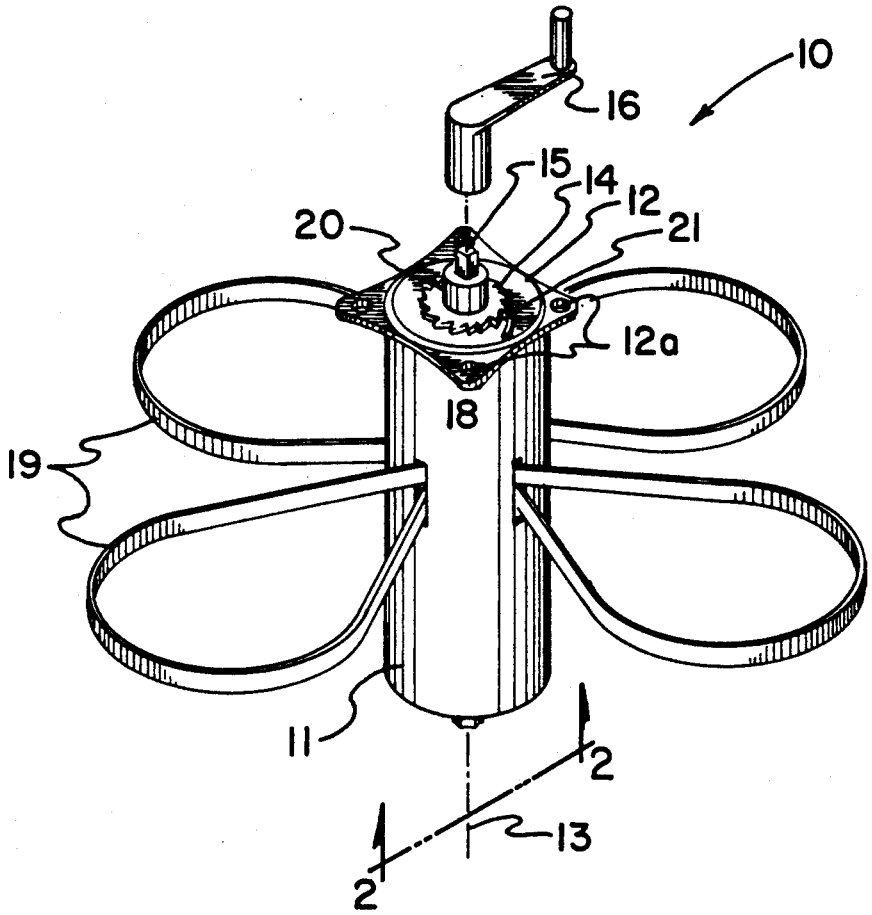
FIG. 1 is an isometric illustration of the instant invention.
Figure 2:
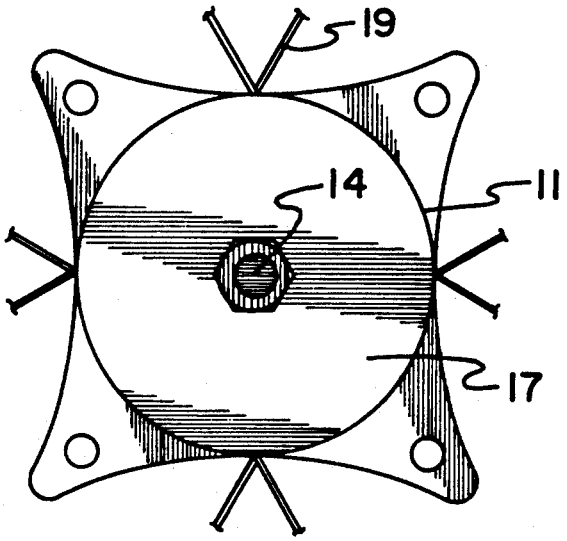
FIG. 2 is an orthographic view, taken along the lines 2—2 of FIG. 1 in the direction indicated by the arrows.
Figure 3:
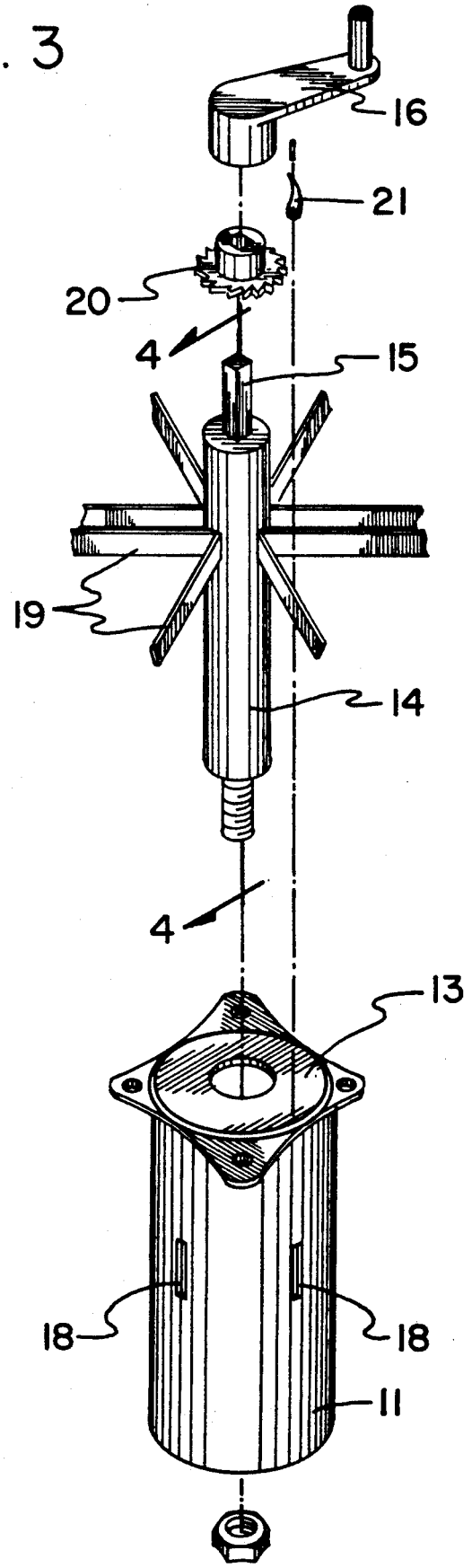
FIG. 3 is an isometric exploded illustration of the invention.
Figure 4:
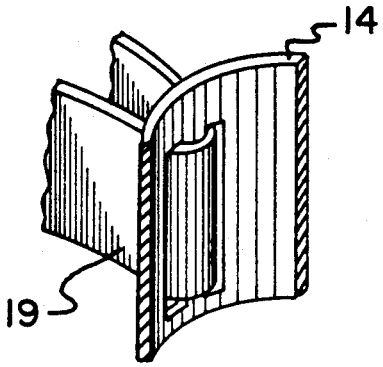
FIG. 4 is an isometric view of a strap member mounted to the central control shaft.

With reference now to the drawings, and in particular to FIGS. 1 to 8 thereof, a new and improved drum handling apparatus embodying the principles and concepts of the present invention and generally designated by the reference numeral 10 will be described More specifically, the drum handling apparatus 10 of the instant invention essentially comprises an outer cylindrical housing 11 defined along an outer housing axis 13. The outer housing 11 includes a top plate 12 spaced from and parallel a bottom plate 17 orthogonally oriented relative to the axis 13 at opposed upper distal ends respectively of the housing 11. Control shaft 14 is rotatably and coaxially mounted relative to the housing 11 between the top plate 12 and the bottom plate 17, including a ratchet sprocket 20 fixedly mounted to the control shaft 14 above the top plate 12. A control shaft drive end 15 coaxially extends upwardly of the ratchet sprocket 20 for reception within a handle member 16 to permit selective rotation of the ratchet sprocket 20 and rotation of the control shaft 14 within the outer housing 11.

The control shaft 14 (see FIG. 3) includes a plurality of flexible continuous encircling straps 19 mounted to the control shaft 14 in an annular array, with the encircling straps 19 spaced apart 90 degrees relative to one another. Each encircling strap 19 is directed through a slot 18 formed within the outer housing 11. The slots 18 are arranged in a parallel relationship relative to one another also in an annular array, wherein the slots 18 and the mounting of the encircling straps 19 to the control shaft 14 are substantially concentric relative to one another.

It should be noted therefore that upon the rotation of the ratchet sprocket 20 and the arresting leg 21 in biased communication with the teeth of the ratchet sprocket 20, rotation of the control shaft 14 effects winding of the encircling straps 19 about the control shaft 14 within the housing 11 permitting the clamping of the straps about plural pairs of drum members (not shown) that are received within the straps 19. In this manner, plural pairs of drums may be secured in a single clamping procedure.

Figure 5:
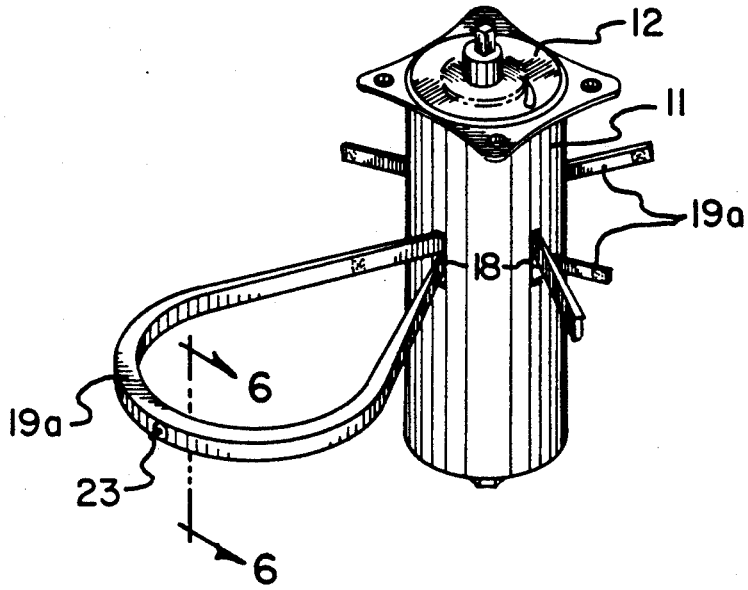
FIG. 5 is an isometric illustration of a modified strap structure utilized by the invention.
Figure 6:
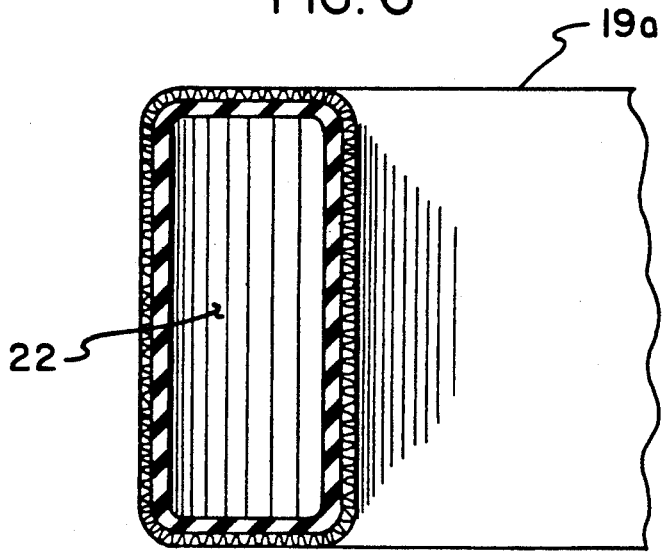
FIG. 6 is an orthographic view, taken along the lines 6—6 of FIG. 5 in the direction indicated by the arrows.
Figure 7:
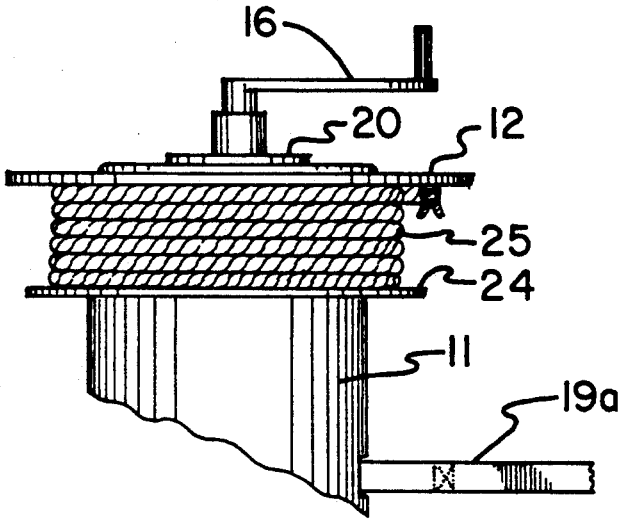
FIG. 7 is an orthographic view, taken in elevation, of a further feature of the invention.
Figure 8:
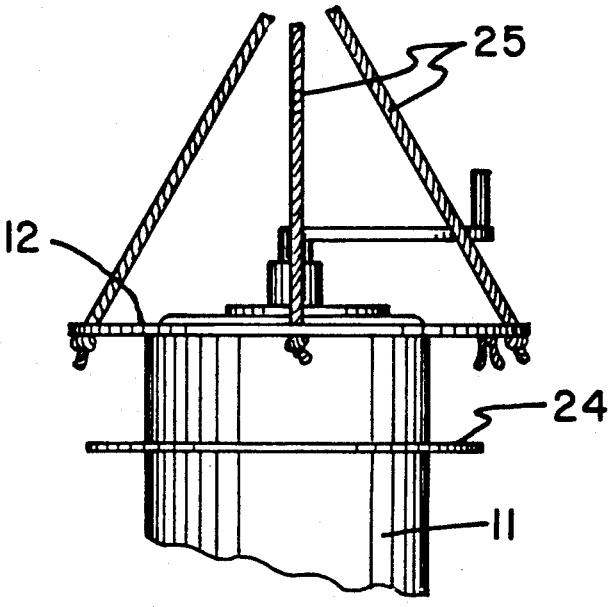
FIG. 8 is an orthographic view of the lifting cables in a raised orientation relative to the outer housing structure.

The FIG. 5 illustrates a modified encircling strap structure 19*a*, wherein each encircling strap 19*a* includes a flexible tubular construction formed with a continuous pneumatic chamber 22 coextensively directed through the modified control strap 19*a*, in a manner as illustrated in the FIGS. 5 and 6. An inflation valve 23 permits selective inflation of each control strap to in this manner permit inflation of the control straps subsequent to clamping of the drums to further enhance the clamping of the drum structure minimizing a drum slippage relative to an associated strap member 19*a*.

The housing 11 further includes a lower flange 24 spaced below and parallel the top plate 12, wherein the top plate, as illustrated in the FIG. 1 for example, includes a plurality of top plate apertures 12*a* arranged ninety degrees relative to one another directed through the top plate adjacent a periphery thereof. Each apertures 12*a* mounts a lifting cable 25 thereto, wherein the lifting cables during periods of non-use are wound about the housing 11 and secured thereto between the top plate 12 and the lower flange 24. In this manner, the cables are conveniently available for the lifting of drums secured by the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drum handling apparatus, comprising, an outer cylindrical housing, the outer cylindrical housing defined along a housing axis, with the housing including a housing upper distal end and a housing lower distal end, wherein the housing upper distal end includes a top plate fixedly mounted to the upper distal end, and a bottom plate mounted fixedly to the lower distal end, wherein the top plate and the bottom plate are arranged in a parallel relationship orthogonally oriented relative to the housing axis, and a control shaft rotatably mounted between the top plate and the bottom plate extending coaxially through the outer cylindrical housing, and the control shaft including a control shaft upper drive end, with the upper drive end receiving a handle thereon, whereupon the handle effects rotation of the control shaft, and the control shaft includes a plurality of strap members, and each strap member extends through the outer housing, whereupon rotation of the control shaft effects winding of the encircling straps about the control shaft.

2. An apparatus as set forth in claim 1 wherein the control shaft includes four encircling straps secured thereto, wherein the encircling straps are arranged in an annular array spaced apart ninety degrees relative to one another, and the outer cylindrical housing includes a plurality of parallel slots directed through the outer housing, wherein the parallel slots are spaced apart ninety degrees in an annular array through the outer cylindrical housing, wherein the slots and the encircling straps are in a concentric relationship relative to one another.

3. An apparatus as set forth in claim 2 including a ratchet sprocket mounted to the control shaft adjacent the top plate, with an arresting leg arranged for abutment with the ratchet sprocket for arresting rotation of the ratchet sprocket.

4. An apparatus as set forth in claim 3 wherein each encircling strap is of continuous flexible construction, and each encircling strap includes a pneumatic chamber directed coextensively within each encircling strap, and each encircling strap includes an inflation valve for effecting selective inflation of each pneumatic chamber of each encircling strap.

5. An apparatus as set forth in claim 4 wherein the outer cylindrical housing includes a lower flange spaced below and parallel the top plate, and the top plate includes a top plate periphery, with the top plate periphery including a plurality of equally spaced apertures directed therethrough, and each aperture includes a lifting cable mounted to each aperture, wherein the lifting cables are arranged for storage between the top plate and the lower flange in a first position and arranged for extension above the top plate in a second lifting position.

* * * * *